US009821573B2

(12) United States Patent
Campanini

(10) Patent No.: US 9,821,573 B2
(45) Date of Patent: Nov. 21, 2017

(54) THERMAL PRINTING DEVICE

(71) Applicant: CUSTOM S.P.A., Fontevivo (Parma) (IT)

(72) Inventor: Alberto Campanini, Fidenza (IT)

(73) Assignee: CUSTOM S.p.A., Fontevivo (Parma) (IT)

( * ) Notice: Subject to any disclaimer, the term of this patent is extended or adjusted under 35 U.S.C. 154(b) by 6 days.

(21) Appl. No.: 15/040,093

(22) Filed: Feb. 10, 2016

(65) Prior Publication Data

US 2017/0144454 A1 May 25, 2017

(30) Foreign Application Priority Data

Nov. 23, 2015 (IT) ..... 102015000075582

(51) Int. Cl.

| | |
|---|---|
| ***B41J 11/04*** | (2006.01) |
| ***B41J 2/335*** | (2006.01) |
| ***B41J 2/32*** | (2006.01) |

(52) U.S. Cl.

CPC ..... *B41J 11/04* (2013.01); *B41J 2/32* (2013.01); *B41J 2/335* (2013.01); *B41J 2/3353* (2013.01)

(58) Field of Classification Search

CPC . B41J 11/02; B41J 11/04; B41J 11/053; B41J 11/057; B41J 11/06; B41J 11/08; B41J 11/10; B41J 11/13; B41J 2/335; B41J 2/325

See application file for complete search history.

(56) References Cited

U.S. PATENT DOCUMENTS

| | | | | |
|---|---|---|---|---|
| 2001/0010773 | A1 | 8/2001 | Nakagaki et al. | |
| 2002/0101499 | A1* | 8/2002 | Poole | B41J 2/325 347/213 |
| 2012/0056964 | A1 | 3/2012 | Matsuoka et al. | |

FOREIGN PATENT DOCUMENTS

| | | | |
|---|---|---|---|
| JP | S5527254 | A | 2/1980 |
| WO | 2011053799 | A2 | 5/2011 |

OTHER PUBLICATIONS

Italian Search Report Application No. IT 102015000075582 Completed: Jul. 15, 2016 7 pages.

* cited by examiner

*Primary Examiner* — Kristal Feggins
(74) *Attorney, Agent, or Firm* — Whitmyer IP Group LLC

(57) ABSTRACT

A thermal printing device with a thermal print head, a platen roller opposite the print head and a protective film that is movable in a closed loop, wherein the thermal print head is arranged inside the closed loop formed by the film, so as to protect the thermal paper from damage caused by mechanical scraping by the print head; a use of the printing device is also disclosed for dispensing a printed ticket in real time, the ticket being at least partly covered by an opaque patina that is removable by scraping after printing to enable what has been printed to be viewed.

18 Claims, 1 Drawing Sheet

THERMAL PRINTING DEVICE

TECHNICAL FIELD

The invention relates to a thermal printing device, in particular for direct thermal printing, i.e. printing in which the printed image is obtained directly on at least one sensitive side of the thermal paper through the effect of the passage of this sensitive side in front of a print head with a heating device.

BACKGROUND

In this description, "direct" thermal printing device is defined as a thermal printing device that is not of the thermal transfer type, i.e. is not of the type in which the ink is transferred through the effect of heat from an intermediate (temporary) disposable support to a normal (definitive) printing support.

In the "direct" thermal printing device in question, the material (ink) intended to form, through the effect of heat, the printing image, is already set up in the veritable printing support (without the need for a transfer from an intermediate disposable support) before traversing the thermal print head.

Specifically, but not exclusively, the invention can be applied to dispense printed documents in real time on thermal paper. The documents can comprise, for example, tickets, receipts, stubs, coupons, vouchers, etc, in particular documents having a particularly delicate or fine printable side, for example a printable side provided with an opaque patina that hides from view what has been printed and which has to be subsequently removed by scraping ("scratch and win" card, "scratch and park" card, etc).

In particular, reference is made to a direct thermal printing device according to the preamble of the first claim. Such a device is widely used for dispensing printed documents in real time on thermal paper.

One of the drawbacks of prior art printing devices is the risk of damage to the printable side of the thermal paper, in particular caused by sliding on the thermal print head.

SUMMARY

One object of the invention is to make a thermal printing device that is able to overcome the aforesaid drawback of the prior art.

One advantage is obtaining high printing quality on a printed document in real time directly on thermal paper.

One advantage is avoiding damage to an opaque patina that is arranged on a printable side of the thermal paper and is removable by scraping.

One advantage is avoiding premature scraping of an opaque patina arranged on a printed document and scrapable at the moment of use.

One advantage is to provide a direct thermal printing device that is constructionally simple and cheap.

Such objects and advantages, and still others, are achieved by the device and the method according to any one of the claims set out below.

In one embodiment, a printing device comprises a thermal print head, a platen roller opposite the print head and a protective film that is movable in a closed loop, in which the print head is arranged inside the closed loop formed by the film, so as to protect the thermal paper from damage caused by mechanical scraping by the print head.

In one embodiment, the printing device is used for dispensing a printed ticket in real time, the ticket being at least partly covered by an opaque patina that is removable by scraping after printing to enable what has been printed to be viewed, the film having the function of preventing undesired scraping of the opaque patina during the step of printing by the print head.

BRIEF DESCRIPTION OF THE DRAWINGS

The invention can be better understood and implemented with reference to the attached drawings that illustrate one embodiment thereof by way of non-limiting example.

DETAILED DESCRIPTION

Figure 2:
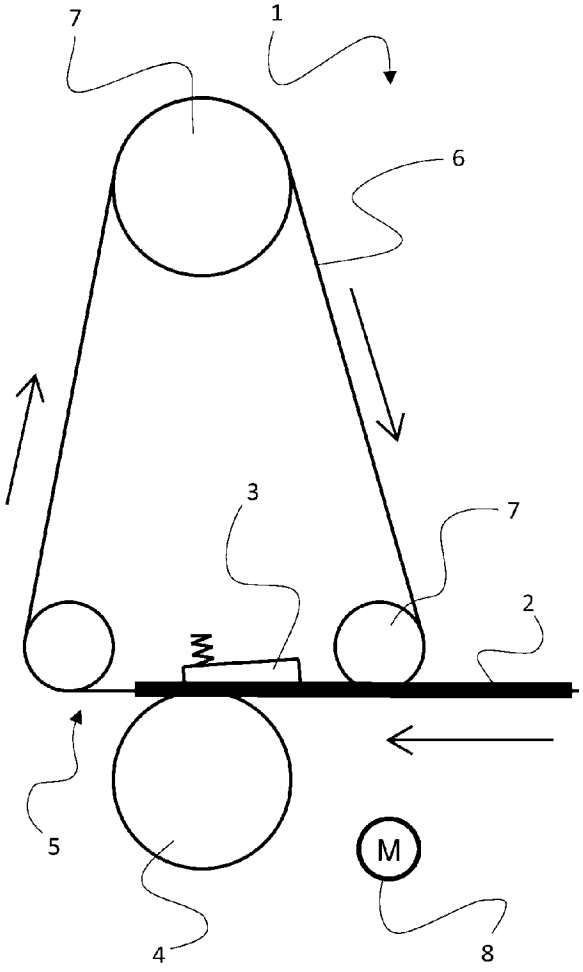
FIG. 2 shows the diagram in FIG. 1 in a subsequent printing step in which the thermal paper is passing in front of the print head.

With reference to the aforesaid figures, with 1 a thermal printing device has been indicated overall which is usable in particular for printing documents, such as for example tickets, receipts, stubs, vouchers, coupons or other types of documents printed in real time. The thermal printing device 1 can be configured, in particular, for thermal printing of direct type, i.e. thermal printing in which the printed image is obtained directly on a sensitive side of the thermal paper through the effect of the passage in front of a print head with a heating device, without the use of an intermediate transferring arrangement that is suitable for transferring the print to the document.

The printing device 1 can be configured for dispensing printed documents on thermal paper in real time. The printed documents can comprise, in particular, documents having a particularly delicate or fine printable side, for example a printable side provided with an opaque patina that hides what has been printed from view and has to be subsequently removed by scraping ("scratch and win" card, "scratch and park" card, etc).

The printing device 1 can comprise, as in this embodiment, a supply path of thermal paper 2.

The printing device 1 can comprise, in particular, a thermal print head 3 arranged on the supply path to generate heat that causes a chemical reaction that is such as to form a print image directly on a printable (chemically sensitive) side of the thermal paper 2.

The printing device 1 can comprise, as in this embodiment, a platen roller 4 opposite the thermal print head 3. The platen roller 4 can be used, in particular, for advancing the thermal paper 2 during printing. It is possible to use (in addition or alternatively to the platen roller 4) another device for advancing the thermal paper 2 to the print head 3 along the supply path.

The print head 3 can be operationally associated with the platen roller 4 (paper-dragging roller) opposite the print head 3. The platen roller 4 can operate in contact with a second side of the thermal paper 2 (opposite the thermally sensitive first printable side). The supply path of the thermal paper 2 passes, in particular, between the print head 3 and the platen roller 4. The platen roller 4 can be controlled (by a programmable electronic control arrangement, which is not illustrated, for example in the form of an electronic circuit) in cooperation with the print head 3, for advancing the paper 2 in a coordinated manner during the document printing step.

The printing device 1 can comprise, in particular, a protection arrangement 5 provided with at least one (flexible) movable portion arranged between the print head 3 and the supply path to protect the thermal paper 2 from the print head 3. The protection arrangement 5 is used, in particular, to prevent mechanical scraping of the printable side of the thermal paper 2 (in particular scraping of the removable opaque patina) by the print head 3. The aforesaid movable portion can be made, in particular, of a transparent material.

The aforesaid portion of the protection arrangement 5 can be arranged, as in this embodiment, between the print head 3 and the platen roller 4.

The protection arrangement 5 can be shaped and arranged, as in this specific embodiment, in such a manner as to form a closed loop. In particular the protection arrangement 5 can comprise a slidable flexible protection element, for example wound in a closed loop. The protection element can be, for example, transparent. The protection element can have, in particular, thermal resistance that is not too high, to permit the heat to be transmitted appropriately from the print head 3 to the thermal paper 2 such as to guarantee a printing of a good quality image. The protection element can be made of a material and have a thickness that are suitable for the thermal resistance to be sufficiently low.

The protection arrangement 5 can be shaped and arranged in such a manner that both the thermal paper 2 that advances along the supply path and the platen roller 4 remain outside the closed loop.

The thermal print head 3 can be arranged, as in this embodiment, inside the closed loop formed by the protection arrangement 5.

The closed loop flexible element can comprise, in particular, at least one (transparent) film 6 wound on winding rollers 7. The film 6 can be wound on three or more winding rollers 7. Each winding roller 7 can comprise a rotation axis parallel to a rotation axis of the platen roller 4.

The film 6 can be made of polymer material. The film 6 can comprise, for example, polyester, in particular Mylar®. The film 6 can be made, for example, of a material and a thickness that are the same as those with which the disposable ribbon can be made that is usually used as an intermediate support of the ink in (known) thermal transfer printing technology.

The aforesaid (flexible) movable portion of the protection arrangement 5 (comprising specifically the film 6) arranged between the print head 3 and the supply path of the thermal paper 2 can be tangent to the platen roller 4. In particular, this portion can be at least partially extended, as in this embodiment, along a plane that is tangent to the platen roller 4.

The protection arrangement 5 can be movable in an idle manner so as to be dragged in movement by the platen roller 4 together with the thermal paper 2. In particular it is possible to provide for each of the winding rollers 7 of the film 6 being mounted idle on the rotation axis thereof.

The printing device 1 can comprise, as in the illustrated embodiment, a driving arrangement 8 arranged for driving the movement of the protection arrangement 5.

The driving arrangement 8 can be connected to the programmable electronic control arrangement, which can be configured to control the driving arrangement 8 in such a manner that in operation the protection arrangement 5 is movable at a speed that is the same as an advancement speed of the thermal paper 2 along the supply path and/or at a speed that is the same as a peripheral speed of the platen roller 4.

In particular, the driving arrangement 8 can comprise an electric motor (for example a step motor), which can be connected both to the platen roller 4, and to the protection arrangement 5, to drive both simultaneously. The driving arrangement 8 can be connected to the platen roller 4 by mechanical transmitting arrangement (which is not illustrated). The driving arrangement 8 can be connected to the protection arrangement 5 by mechanical transmitting arrangement (which is not illustrated). The driving arrangement 8 can be of the reversible type, to allow the thermal paper 2 and the protection arrangement 5 backward motion. The backward motion can be supplied to the thermal paper 2 in certain operating conditions, for example in a paper aligning step. In this case the protection arrangement 5 can also have the possibility of performing a backward motion in coordination with the thermal paper 2, in particular at the same reversing speed.

As said, the printing device 1 can be used, in particular, for direct thermal printing of thermal paper 2 in which the printable side of the paper, which is chemically sensitive to heat, facing the print head 3 can be covered by an opaque patina intended for being removed by scraping to enable what has been printed to be viewed. In this context, the movable (closed loop) protection arrangement 5 can be used to prevent undesired premature scraping of the opaque patina by the print head.

It is nevertheless possible to use the printing device 1 in other contexts, in particular for direct thermal printing of thermal paper 2 in which the printable side of the paper facing the print head 3 is particularly delicate or fine, for example because covered with a decoration of a certain value, in order to prevent damage to the printable side by the print head 3.

In the specific embodiment illustrated here, the thermal paper 2 is supplied in the form of a discrete element (preformed single document). It is nevertheless possible to provide for thermal paper to be supplied in the form of a continuous element, for example a ribbon that can be unwound from a reel. In this case the printing device 1 can comprise a cutting device (which is not illustrated) to separate the printed document from the rest of the continuous element (ribbon), in particular when the document is (stationary) in a cutting zone (station). The cutting device can comprise, for example, a movable motor-driven blade cooperating with a stationary blade.

The printing device 1 can comprise, in particular, a magazine (not shown) for housing the thermal paper, for example in the form of a plurality of discrete (stacked) printable elements or of at least one continuous printable element (a ribbon on a reel, a set of sheets in continuous fan-fold format, a set of sheets—for example labels—arranged in a row on a supporting ribbon, etc). The magazine can comprise, in particular, at least a seat arranged for receiving the thermal paper.

The printing device 1 can comprise, in particular, a containing body (not shown), or framework, (for example of a box shape) that is suitable for containing the various components of the device or at least a part thereof.

The printing device 1 can comprise, in particular, the aforesaid (programmable electronic) control arrangement, comprising for example at least one electronic card connected to sensors and actuators of the printing device. The printing device 1 can comprise, in particular, program instructions that are implementable on this programmable control arrangement to perform the printing steps.

Figure 1:
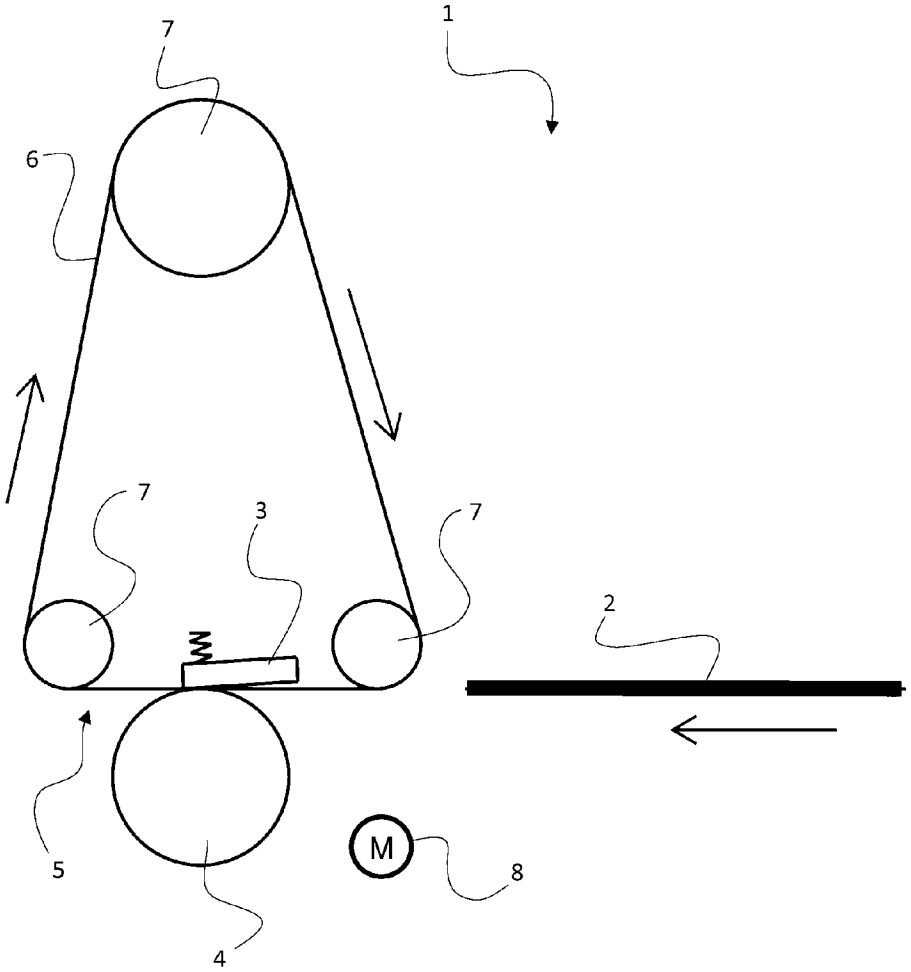
FIG. 1 is a diagram of one embodiment of a printing device, made according to the invention, during a printing step in which the thermal paper is approaching the print head.

In use, the thermal paper 2 is supplied to the print head 3 (FIG. 1). During the veritable printing, i.e. when the thermal paper 2 is coupled between the print head 3 and the platen roller 4 with the chemically sensitive side in front of the print head, the head 3 and the roller 4 operate in reciprocal coordination to print on the thermal paper 2 whilst the latter advances (FIG. 2). In the printing step the protection arrangement 5 (film 6) is arranged between the print head 3 and the thermal paper 2 and is movable, in particular at a movement speed that is the same as the advancement speed of the paper 2. As said, the movement of the protection arrangement 5 can be driven by the driving arrangement 8 (for example the driving arrangement that controls rotation of the platen roller 4) that controls the rotation of at least one of the winding rollers 7 (for example the roller 7 of larger diameter, with reference to the figures). The movement of the protection arrangement 5 can be caused and/or facilitated by the rotation of the platen roller 4 that, in addition to advancing the thermal paper 2, drags forwards (in the same advancement direction as the thermal paper 2) also the protection arrangement 5. The movement of the protection arrangement 5 can be caused and/or facilitated by the advancement of the thermal paper 2 that can drag with itself the protection arrangement 5.

The protection arrangement 5 (in particular the flexible protection element can comprise the film 6) protects the thermal paper 2 from the risk of damage caused by the rubbing contact of the printable side of the paper against the print head 3. At the same time, the protection arrangement 5 can be traversed by the thermal energy generated by the print head 3 in such a manner as to activate thermally the chemically sensitive side of the thermal paper 2 and produce the print. In other words, the protection arrangement 5 performs the function of protecting the paper from scraping without representing a significant obstacle to the heat required for forming the print image.

In the embodiment disclosed above, the protection arrangement 5 comprises at least one flexible protection element arranged as a closed loop. It is nevertheless possible to provide other embodiments, for example in which the protection arrangement comprises at least one flexible element (in particular the film 6) that is not wound in a closed loop, but is unwound from an inlet reel and is rewound on an outlet reel.

As said, the thermal paper 2 can be moved selectively forward, i.e. to an outlet where a user can remove the printed document in real time, or backwards, i.e. reversing in a direction that is opposite the outlet direction, for example to perform alignment of the thermal paper 2 with the print head 3. This could cause strong scraping due to the acute angle of the head, which is often designed for monodirectional movement of the paper. The setup of the protection arrangement 5 enables also this drawback to be prevented.

What is claimed is:

1. A direct thermal printing device, comprising:

a supply path of thermal paper;

a thermal print head arranged on said supply path to generate heat that causes a chemical reaction that forms a print image directly on a side of the thermal paper;

a platen roller opposite to said thermal print head;

a movable protection arrangement with at least one portion arranged between said print head and said supply path to protect the thermal paper, in particular to prevent a mechanical scraping by said print head; and a driving arrangement for driving in motion said protection arrangement, said protection arrangement being optionally movable with a speed equal to a forward or backward speed of the thermal paper along said supply path and/or equal to a peripheral speed of said platen roller.

2. A device according to claim 1, wherein said protection arrangement comprises at least one flexible element wound in a closed loop.

3. A device according to claim 2, wherein said thermal print head is arranged inside the closed loop of said at least one flexible element.

4. A device according to claim 2, wherein said at least one flexible element is wound in a closed loop on winding rollers each with an axis parallel to an axis of said platen roller.

5. A device according to claim 2, wherein said protection arrangement is movable in an idle manner to be dragged by said platen roller together with the thermal paper.

6. A device according to claim 5, wherein said protection arrangement comprises at least one film of polymeric material, for example polyester.

7. A device according to claim 2, wherein said driving arrangement comprises an electric motor, in particular a reversible motor drivable in two opposite directions, connected both with said platen roller and with said protection arrangement to actuate them both simultaneously.

8. A device according to claim 2, wherein said at least one portion of the protection arrangement that is arranged between said print head and said supply path of the thermal paper extends along a plane tangent to said platen roller.

9. A device according to claim 1, wherein said protection arrangement comprises at least one film of polymeric material, for example polyester.

10. A device according to claim 1, wherein said protection arrangement is movable in an idle manner to be dragged by said platen roller together with the thermal paper.

11. A device according to claim 1, wherein said driving arrangement comprises an electric motor, in particular a reversible motor drivable in two opposite directions, connected both with said platen roller and with said protection arrangement to actuate them both simultaneously.

12. A device according to claim 11, wherein said protection arrangement comprises at least one flexible element wound in a closed loop, said thermal print head being arranged inside the closed loop of said at least one flexible element.

13. A device according to claim 11, wherein said protection arrangement comprises at least one flexible element wound in a closed loop, said at least one flexible element being wound in a closed loop on winding rollers each with an axis parallel to an axis of said platen roller.

14. A device according to claim 1, wherein said at least one portion of the protection arrangement that is arranged between said print head and said supply path of the thermal paper extends along a plane tangent to said platen roller.

15. A device according to claim 14, wherein said driving arrangement comprises an electric motor, in particular a reversible motor drivable in two opposite directions, connected both with said platen roller and with said protection arrangement to actuate them both simultaneously.

16. A device according to claim 14, wherein said protection arrangement comprises at least one flexible element wound in a closed loop, said thermal print head being arranged inside the closed loop of said at least one flexible element.

17. A device according to claim 14, wherein said protection arrangement comprises at least one flexible element wound in a closed loop, said at least one flexible element being wound in a closed loop on winding rollers each with an axis parallel to an axis of said platen roller.

18. Use of a device according to claim 1 for direct thermal printing of thermal paper in which a printable side facing the print head is covered by an opaque patina destined to be removed by scraping by a user to enable a vision of what has been printed, in which the movable protection arrangement prevents a premature scraping of said opaque patina by the print head.

* * * * *